US007096598B1

(12) United States Patent
Myatt

(10) Patent No.: US 7,096,598 B1
(45) Date of Patent: Aug. 29, 2006

(54) HAIR STYLING BRUSH WITH REVERSE AIR FLOW

(75) Inventor: Tommy Leon Myatt, Edmond, OK (US)

(73) Assignee: Natural Volume Systems, L.L.C., Edmond, OK (US)

( * ) Notice: Subject to any disclaimer, the term of this patent is extended or adjusted under 35 U.S.C. 154(b) by 1550 days.

(21) Appl. No.: 09/610,196

(22) Filed: Jul. 5, 2000

(51) Int. Cl.
*A45D 1/00* (2006.01)

(52) U.S. Cl. ..... 34/96

(58) Field of Classification Search ..... 34/283, 34/73–101; 15/160; 132/227–271, 118
See application file for complete search history.

(56) References Cited

U.S. PATENT DOCUMENTS

| | | | | |
|---|---|---|---|---|
| 2,999,263 A | | 9/1961 | Smith | |
| 3,911,934 A | * | 10/1975 | Helbling | 132/271 |
| 4,210,162 A | | 7/1980 | Dreyer et al. | |
| 4,254,324 A | | 3/1981 | Vrtaric | |
| 4,309,595 A | | 1/1982 | Long et al. | |
| 4,664,132 A | * | 5/1987 | Schillig | 132/271 |
| 4,667,405 A | | 5/1987 | Trichell et al. | |
| 4,721,121 A | | 1/1988 | Adams | |
| 4,799,460 A | | 1/1989 | Kuhl | |
| 5,095,853 A | | 3/1992 | Kruger | |
| 5,211,131 A | | 5/1993 | Plyler | |
| 5,373,607 A | | 12/1994 | Hwang | |
| 5,435,327 A | * | 7/1995 | Ho | 132/118 |
| 5,462,018 A | * | 10/1995 | Louison | 119/626 |
| 5,661,910 A | * | 9/1997 | Schepisi | 34/97 |
| 5,870,851 A | | 2/1999 | Shoemaker | |
| 5,924,215 A | | 7/1999 | Goodsell | |
| 6,725,562 B1 | * | 4/2004 | Nakagawa et al. | 34/96 |
| 6,782,636 B1 | * | 8/2004 | Feldman | 34/96 |

* cited by examiner

*Primary Examiner*—Daniel Robinson
(74) *Attorney, Agent, or Firm*—Mary M. Lee

(57) ABSTRACT

A hair styling brush with reverse airflow. The preferred styling brush has a contoured, bristled body for holding locks of hair in a curved or curled position. The body is perforated, and a blower in the brush draws air in through the perforations across the damp hair. This styling brush preferably is used with a conventional blow dryer or curling iron. When using a blow dryer, warm air from the blow dryer is directed at the lock of hair on the styling brush, while the blower in the styling brush pulls the warm air through the hair. Alternately, after a lock of hair has been styled on a curling iron, the lock then can be cooled rapidly using the styling brush. The styling brush is designed to direct the exhaust air toward the handle. In this way, the user can tell from the temperature of the exhaust when the hair is dry. More specifically, once the hair on the brush is dry, the exhaust air will begin to feel warmer as the evaporation process is no longer cooling it.

5 Claims, 4 Drawing Sheets

HAIR STYLING BRUSH WITH REVERSE AIR FLOW

FIELD OF THE INVENTION

The present invention relates generally to hair styling brushes.

BACKGROUND OF THE INVENTION

Hand-held blow dryers have rapidly become one of the most popular devices for drying hair. A styling brush is often used with a blow dryer, to style and curl the hair as it is dried. While the use of conventional styling brushes provides good styling capability, there remains a need to improve the ability of the styling brush to hold the lock of hair in a desired shape and to hasten the drying process. Further, there is a need to reduce the likelihood that hair will be damaged by over-exposed to the heated air. Still further, there is a need for a styling brush that can effectively cool the hair after it has been dried and while it is stabilized in the desired configuration. This post-styling cooling step makes the hair shafts look and feel smoother, enhances the volume and makes the hair less prone to tangles.

SUMMARY OF THE INVENTION

The present invention is directed to a hair styling brush. The brush includes a body with a curved, perforated surface. Bristles extend from the curved, perforated surface of the body, and the bristles and the curved perforated surface are adapted to cooperate to support a lock of the user's hair in a selected shape. A handle extends from the body. Also included is a blower assembly operatively associated with the body and positioned to draw air through the curved, perforated surface of the body when hair is supported thereon.

In another aspect, the present invention is directed to a hair styling brush having a body with a perforated surface and a handle extending from the body. Bristles extend from the perforated surface of the body, and the bristles and the perforated surface are adapted to cooperate to support a lock of the user's hair in a selected shape. A blower housing is between the handle and the body, and a blower assembly is supported therein. The blower assembly is configured to draw air through the perforated surface of the body when hair is supported thereon. The blower housing includes exhaust holes positioned to direct airflow from the blower assembly toward the handle so that the exhaust air will contact the user's hand.

In a further embodiment, the present invention comprises a method for styling hair. In accordance with the method, a lock of hair to be styled first is selected. Next, the lock of hair is supported on a perforated surface. Then, air from a first blower is blown towards the lock of hair. In addition, air from a second blower is drawn across the lock of hair and through the perforated surface.

In still another aspect, the inventive method for styling hair comprises supporting a lock of hair in a desired shape and applying heat to the lock of hair. Then, the lock is supported on a perforated surface, and ambient air is drawn across the lock of hair and through the perforated surface to cool the lock of hair.

BRIEF DESCRIPTION OF THE DRAWINGS

FIG. 6 shows the styling brush in use with a blow dryer in accordance with one embodiment of the method of the present invention.

DETAILED DESCRIPTION OF THE PREFERRED EMBODIMENT

Figure 1:
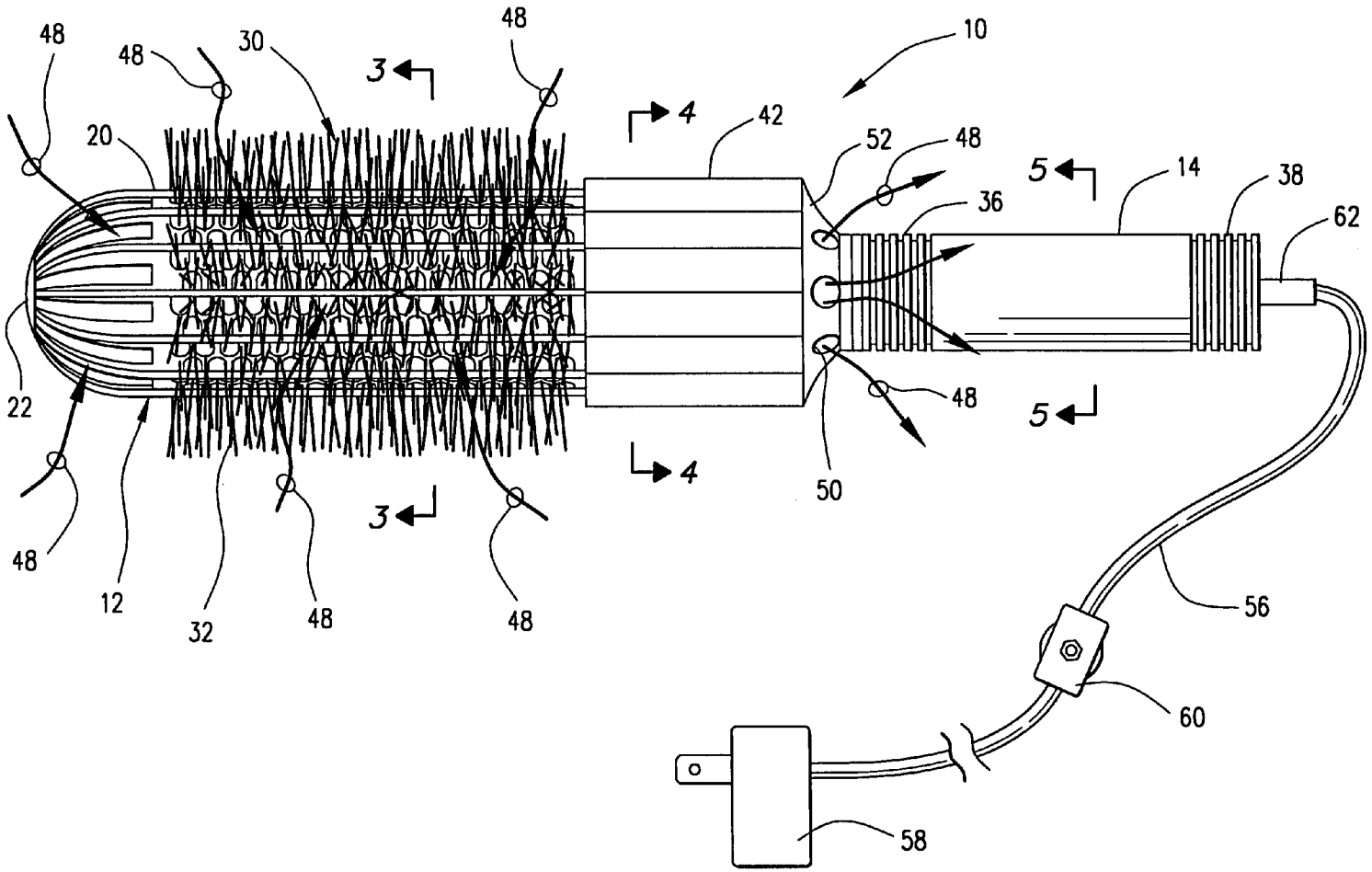
FIG. 1 shows a side elevational view of a styling brush in accordance with the present invention.
Figure 2:
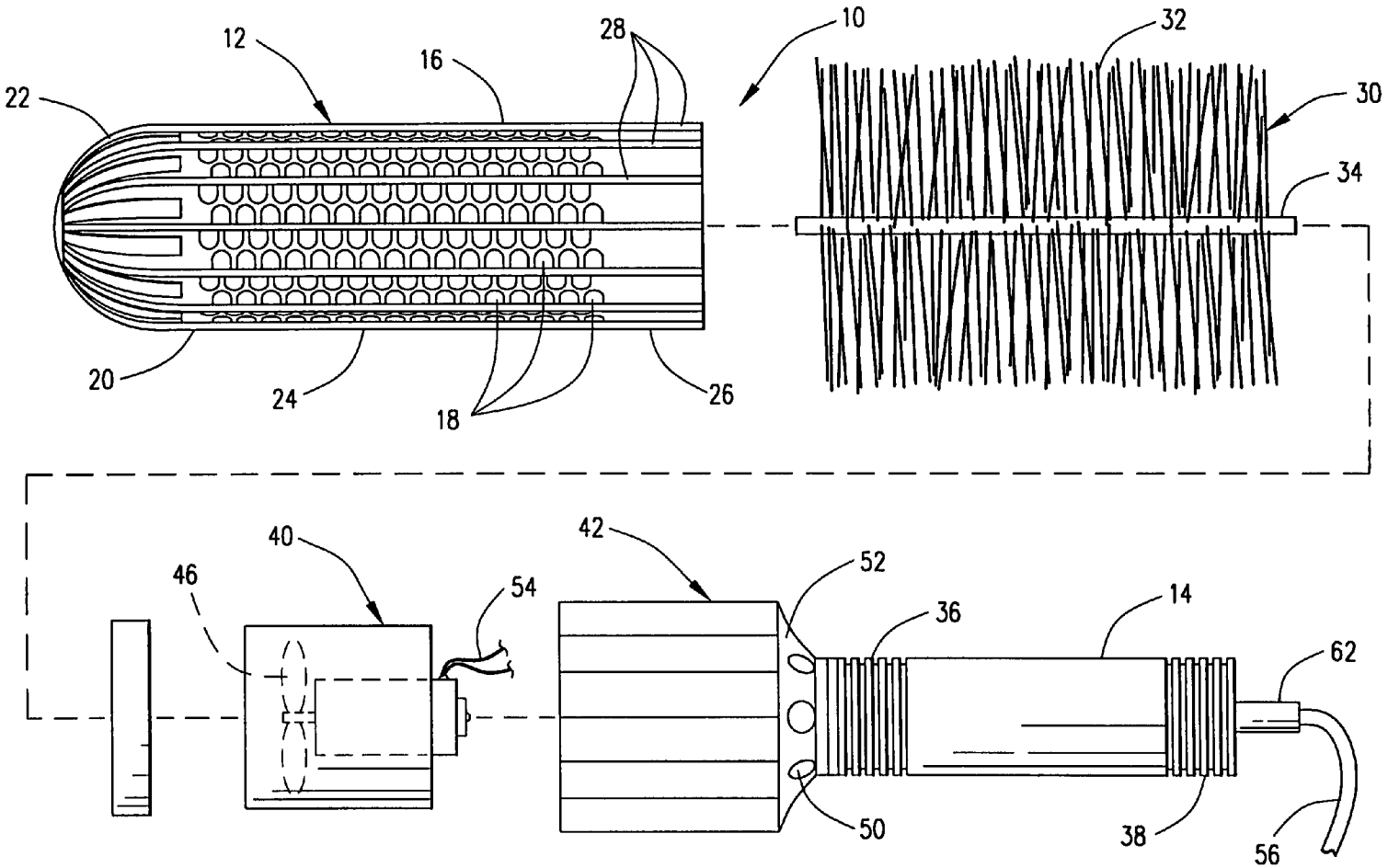
FIG. 2 shows an exploded view of the styling brush shown in FIG. 1.

Turning now to the drawings in general and to FIGS. 1 and 2 in particular, there is shown therein a hair styling brush made in accordance with the present invention and designated generally by the reference numeral 10. The brush 10 generally comprises a body 12 and a handle 14 extending from the body for supporting the body.

The body 12 preferably has a curved, perforated surface. To that end, the body 12 advantageously may be formed of a hollow tube 16 covered with perforations 18 and terminating at the front end 20 with a blunt, slotted nose 22. This provides a continuously curved or cylindrical surface 24. The rear end 26 of the body is open and the outer surface may include splines 28 for assembly with the other components as yet to be described.

Figure 3:
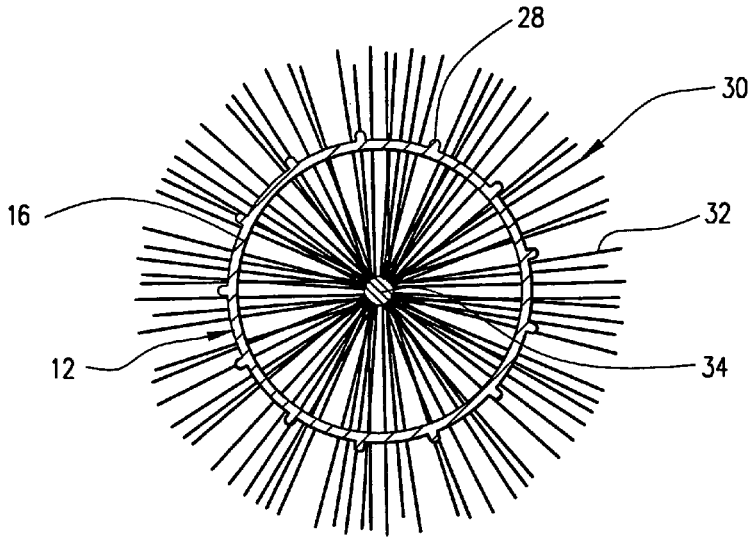
FIG. 3 shows a cross sectional view along the line 3—3 in FIG. 1.

The brush 10 preferably also includes bristles 30. The bristles 30 extend from the curved, perforated surface 24. As best shown in FIGS. 2 and 3, in the preferred construction the bristles 30 comprise a plurality of long, flexible filaments 32 extending radially from a wire core 34. This is a convenient design, as the core 34 can be simply inserted in the tube 16 so that the filaments 32 extend through the perforations 18. Alternately, the bristles can be rigid. For example, rigid bristles could be formed directly on the curved surface 24 between the perforations 18.

Now it will be appreciated that the bristles 30 and the curved surface 24 are adapted to cooperate to support a lock of hair in a curled shape. Thus, it will be apparent that neither the number nor the shape of the bristles is critical. Similarly, although the cylindrical shape is preferred, a non-cylindrical curved surface will suffice. In still other embodiments, the perforated surface may be flat.

Returning to FIGS. 1 and 2, the handle 14 may take any suitable shape. In the present embodiment, the handle 14 is a hollow cylinder with a first end 36 and a second end 38. This allows a good gripping surface on the outside and a conduit for electrical wires in a known manner on the inside.

The hair styling brush 10 preferably further comprises a blower assembly 40 adapted to draw air in through the perforations 18 in the body 12 and the slotted nose 22. Suitable blower assemblies are commercially available, only one exemplary model being illustrated herein.

Figure 4:
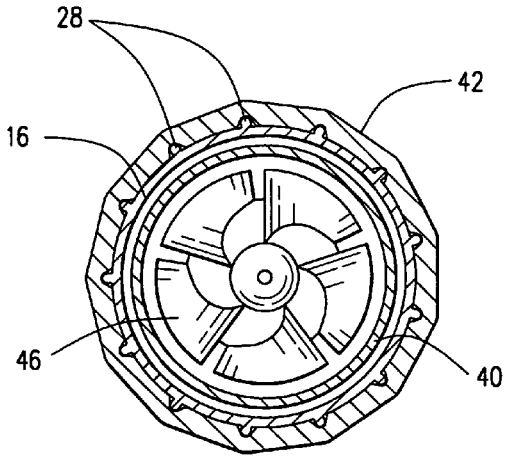
FIG. 4 shows a cross sectional view along the line 4—4 in FIG. 1.

As best seen in FIG. 2, the blower assembly 40 may be supported in a blower housing 42, preferably between the handle 14 and the body 12. More preferably, the blower housing 42 may be formed as an extension of the handle 14, as this simplifies construction and assembly. As best seen in FIG. 4, the inside of the blower housing 42 preferably includes a plurality of longitudinal grooves 44 sized and positioned to receive the splines 28 on the rear end 26 of the body 12. A screen or hair filter (not shown) may be interposed between the blower assembly 40 and the body 12.

Figure 5:
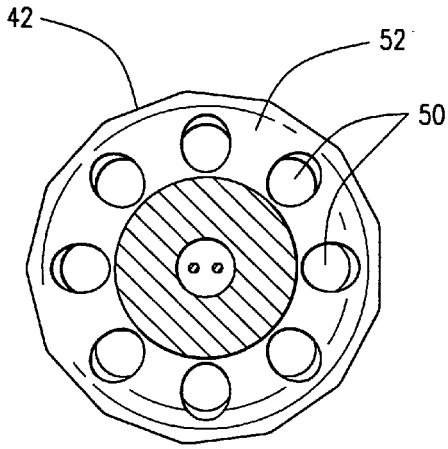
FIG. 5 shows a cross sectional view along the line 5—5 in FIG. 1.
Figure 5:
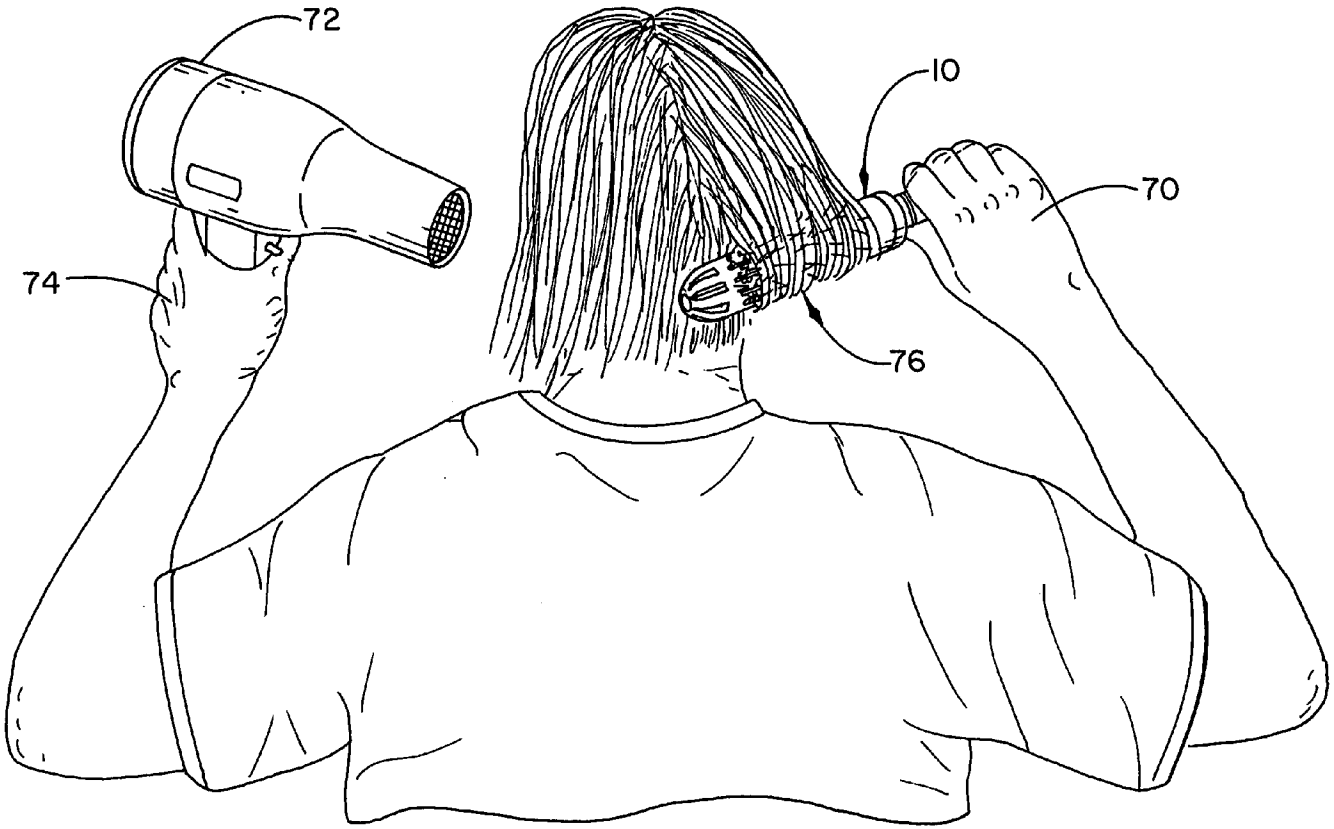

The blower assembly 40 is selected to have, or is modified to have, an outer dimension that fits inside the blower housing 42. The blower assembly 40 is arranged so that the fan 46 will draw air in the direction shown by the arrows 48 (FIG. 1). Exhaust air from the fan 46 is directed out of the blower housing 42 through exhaust holes 50 in the rear end 52 of the housing, depicted in FIGS. 1, 2 and 5, toward the handle 14.

The blower assembly 42 is electrically connectable to a power source (not shown), such as alternating or direct current. Alternately, other power sources such as compressed air or butane may be utilized. To that end, in the preferred embodiment, wires 54 and an insulated electrical cord 56 extend from the blower assembly 40 through the hollow handle 14 in a known manner. The cord 56 is adapted to connect to a conventional 120-volt household outlet by means of an AC adapter plug 58. An on-off switch 60 may be included in the cord 56 or elsewhere. More preferably, the cord 56 is attached to the rear end 38 of the handle 14 by means of a swivel connector 62.

Returning to FIG. 2, the assembly of the brush 10 will be explained. First the bristles 30 are positioned in the tube 16 with the filaments 32 extending through the perforations 18. Next, the blower assembly 40 is positioned in the blower housing 42, and the wires 54 are connected to the leads (not shown) for the cord 56. Next, the rear end 26 of the tube 16 is inserted coaxially between the blower assembly 40 and the blower housing 42 by aligning the splines 28 on the tube with the grooves 44 on the inside of the blower housing, as illustrated in FIG. 4. This connection preferably is so snug that the frictional engagement is sufficient to maintain the engagement. However, it will be apparent that other forms of connection, such as threads, detents, and the like, may be employed instead.

With reference now to FIG. 6, the use of the styling brush 10 in accordance with the method of the present invention now will be described. First, the hair is supported in a desired configuration. For example, the lock of hair may be curled around a curling iron or a curved perforated styling brush, as described above. Further, the hair may be held in a substantially straight position by pulling the styling brush (flat or curved) through the hair against the head.

Next, heat is applied to the lock of hair while it is in the desired shape. For example, as shown in FIG. 6, the styling brush 10 may held in one hand 70 while a conventional blow dryer 72 is held in the other hand 74. The lock of hair 76 to be styled first is supported in a curved shape around the brush 10. Air from the blow dryer, or first blower, is directed towards the lock of hair 76 on the brush 10. At the same time, the blower assembly or second blower in the brush is drawing air in through the perforated surface of the body of the brush 10 across the wet lock of hair 76. This two-component blowing operation is continued until the lock of hair 76 is dried and shaped to satisfaction. Alternately, the lock of hair may be supported on a heated curling iron until the desired shape is achieved.

Next, the shaped hair is cooled while being supported in the desired shape. Where the hair has been shaped by applying warm air from a blow dryer to the hair on the styling brush, the hair can be cooled by simply removing the blow dryer. Where the hair has been shaped by using a curling iron, the hair is removed from the curling iron and supported in similar shape on the styling brush. While supported on the styling brush, the hair is cooled by drawing ambient air through the hair and through the perforated surface on the styling brush.

Now it will be understood that the negative pressure around the perforated surface 24 of the body 12 of the brush 10 created by the reverse air flow will cause the lock of hair 76 to "hug" the brush better than with bristles alone. Still further, as indicated previously, the exhaust holes 50 in the blower housing 42 cause the exhaust air from the brush 10 to flow towards the handle and across the user's hand 70. While the hair is very wet, the evaporative process will cool even very warm air from the blow dryer 72, and consequently the exhaust air will feel cool against the user's hand. As the hair dries, however, the exhaust air will become increasingly warm signaling to the user that the lock of hair 76 is dry and to remove the blow dryer. In this way, damage from over-drying of the hair can be avoided.

The ability of the reverse airflow to rapidly cool the hair by pulling room air through the brush enhances the volume of the hair and renders the hair shafts smoother. Hair is made compliant by applying heat, such as by blowing warm air on the hair or with a curling iron. When the heat is removed and cool air is applied to the hair, the shape is "set." This has a more lasting effect on the shape of the hair than simply releasing the warmed (still compliant), styled hair.

Changes can be made in the combination and arrangement of the various parts and elements described herein without departing from the spirit and scope of the invention as defined in the following claims.

What is claimed is:

1. A hand-held hair styling brush for use by a user to style hair, the brush comprising:

a body with a curved, perforated surface;

bristles extending from the curved, perforated surface of the body;

wherein the bristles and the curved perforated surface are adapted to cooperate to support a lock of hair in a selected shape;

a handle extending from the body; and blower assembly operatively associated with the body and positioned to draw air through the curved, perforated surface of the body when hair is supported thereon.

2. The hair styling brush of claim 1 wherein the blower assembly is contained within a blower housing positioned between the body and the handle, wherein the blower housing is provided with exhaust holes positioned to direct air flow from the blower assembly toward the handle so that the exhaust air will contact the hand of the user.

3. The hair styling brush of claim 2 wherein the curved perforated surface of the body is further defined as cylindrical.

4. The hair styling brush of claim 1 wherein the curved perforated surface of the body is further defined as cylindrical.

5. The hair styling brush of claim 1 wherein the bristles are flexible.

* * * * *